US008322113B2

(12) United States Patent
Shapiro et al.

(10) Patent No.: US 8,322,113 B2
(45) Date of Patent: Dec. 4, 2012

(54) THERMOPLASTIC ROOFING SYSTEM

(75) Inventors: Hal Steven Shapiro, Englewood, CO (US); Brian Francis Olson, Highlands Ranch, CO (US); Timothy J. Olehowski, Lewiston, ME (US); Brian Gregory Shamas, Denver, CO (US)

(73) Assignee: Johns Manville, Denver, CO (US)

( * ) Notice: Subject to any disclaimer, the term of this patent is extended or adjusted under 35 U.S.C. 154(b) by 57 days.

(21) Appl. No.: 12/721,694

(22) Filed: Mar. 11, 2010

(65) Prior Publication Data

US 2011/0219715 A1 Sep. 15, 2011

(51) Int. Cl.
*E04B 1/00* (2006.01)

(52) U.S. Cl. ..... 52/746.11; 52/410; 52/506.01

(58) Field of Classification Search ..... 52/309.2, 52/314, 316, 408, 410, 413, 506.01, 746.11, 52/745.21, 528, 542
See application file for complete search history.

(56) References Cited

U.S. PATENT DOCUMENTS 4,063,395 A * 12/1977 Stewart et al. ..... 52/309.5
4,707,961 A * 11/1987 Nunley et al. ..... 52/408
5,572,843 A * 11/1996 Jordan ..... 52/410
5,737,892 A * 4/1998 Greenberg ..... 52/469
6,230,461 B1 5/2001 Pirout
6,354,045 B1 * 3/2002 Boone et al. ..... 52/95
6,554,947 B2 * 4/2003 Pfotenhauer et al. ..... 156/304.1
6,764,260 B1 * 7/2004 Nebesnak et al. ..... 411/82
6,938,386 B2 * 9/2005 Ritland et al. ..... 52/408
7,104,020 B1 * 9/2006 Suttle ..... 52/551
7,413,392 B2 * 8/2008 Nebesnak et al. ..... 411/531
7,622,187 B2 * 11/2009 Clarke et al. ..... 428/343
7,861,478 B2 * 1/2011 Kalkanoglu et al. ..... 52/410
7,935,202 B2 * 5/2011 Stanley ..... 156/71
8,202,596 B2 * 6/2012 Yang et al. ..... 428/40.1

* cited by examiner

*Primary Examiner* — William Gilbert
*Assistant Examiner* — Gisele Ford
(74) *Attorney, Agent, or Firm* — Robert D. Touslee

(57) ABSTRACT

Provided is a roofing system comprising a thermoplastic roofing membrane and one or more raised metal profiles attached to the thermoplastic roofing membrane. In an embodiment, provided is a method of improving a roofing system comprising a thermoplastic roofing membrane. The method comprises installing one or more thermoplastic coated raised metal profiles on the roofing system. A side of the one or more thermoplastic coated raised metal profiles comprises a thermoplastic layer. Installing the one or more thermoplastic coated raised metal profiles on the roofing system comprises welding the thermoplastic layer to the thermoplastic roofing membrane. The presently disclosed raised profiles provide not only desirable aesthetics to thermoplastic roofing systems, but can also provide structural benefits to the roofing system.

21 Claims, 4 Drawing Sheets

THERMOPLASTIC ROOFING SYSTEM

BACKGROUND

Thermoplastic roofing systems are desirable due to their strength, durability, and ease of installation. However, thermoplastic roofing systems are generally uniform in appearance and may not provide the look desired in a given application.

U.S. Pat. No. 6,230,461 discloses a roof cover comprising a synthetic plastic sealing membrane and several synthetic plastic bars arranged parallel to one another on the surface of the sealing membrane. The synthetic plastic bars are mechanically fixed to a roof element and each of the bars consists of a single-piece synthetic plastic section, soldered onto the sealing membrane.

What is needed is a roofing system that exhibits good strength and durability, but provides desirable aesthetics as well as other additional benefits.

SUMMARY

Provided is a roofing system comprising a thermoplastic roofing membrane and one or more raised metal profiles attached to the thermoplastic roofing membrane. In an embodiment, provided is a method of improving a roofing system comprising a thermoplastic roofing membrane. The method comprises installing one or more thermoplastic coated raised metal profiles on the roofing system. A side of the one or more thermoplastic coated raised metal profiles comprises a thermoplastic layer. Installing the one or more thermoplastic coated raised metal profiles on the roofing system comprises welding the thermoplastic layer to the thermoplastic roofing membrane. The presently disclosed raised profiles provide not only desirable aesthetics to thermoplastic roofing systems, but can also provide structural benefits to the roofing system.

DETAILED DESCRIPTION

Single ply roofing membranes, in particular, thermoplastic roofing membranes, such as, for example, thermoplastic polyolefin (TPO) and polyvinyl chloride (PVC) membranes, provide excellent weatherability and long-term strength and flexibility, as well as excellent resistance to punctures and tears. Single ply membranes provide many choices to suit a variety of applications and needs.

Single ply roofing membranes provide for ease of heat welding and flexibility in a wide range of temperatures. Single ply roofing membranes can be fully adhered, mechanically fastened or ballasted, and provide high performance in both new roof and re-cover applications.

In addition, PVC is exceptionally resistant to chemicals, grease and UV light. And white TPO and PVC membranes provide high reflectivity and emissivity without an additional coating, which keeps buildings cooler, reducing energy consumption and power bills.

TPO roofing systems can combine both polypropylene (plastic) and ethylene-propylene (rubber), resulting in a roofing system that is reliable, cost effective, environmentally friendly and easy to install. TPO roofing systems can be installed fully adhered or mechanically fastened.

PVC roofing systems result in a cleaner, quicker, more economical installation able to withstand heat, wind, rain, varying temperatures and many contaminants. The heat-weldable seams provide a unified, watertight seal as strong as the membrane itself. PVC roofing systems can be installed fully adhered or mechanically fastened.

The presently disclosed roofing system provides the benefits of, for example, a TPO, or any other any thermoplastic, roofing system as well as aesthetic and structural improvements. In particular, the presently disclosed roofing system comprises a thermoplastic roofing membrane and one or more raised metal profiles. The one or more raised metal profiles are attached to the thermoplastic roofing membrane. The one or more raised metal profiles can comprise one or more thermoplastic coated raised metal profiles, for example, PVC coated metal.

Figure 1:
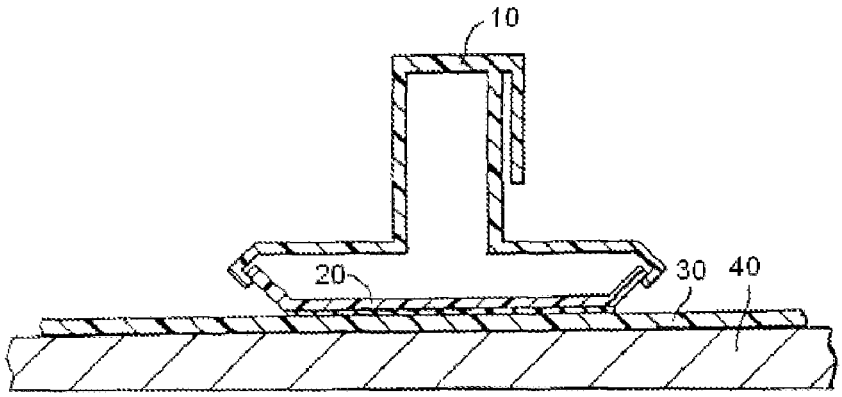
FIG. 1 is a cross-sectional view of the presently disclosed roofing system.

FIG. 1 is a cross-sectional view of the presently disclosed roofing system, including one or more thermoplastic roofing membranes. As shown in FIG. 1, the presently disclosed raised profile can comprises a cap member 10 that is attached to a base member (or snap-fit component) 20. The cap member 10 is a separate piece from the base member (or clip) 20 and snaps over the base member 20. The roofing system includes thermoplastic roofing membrane 30 which itself can overlie a deck 40.

Figure 2:
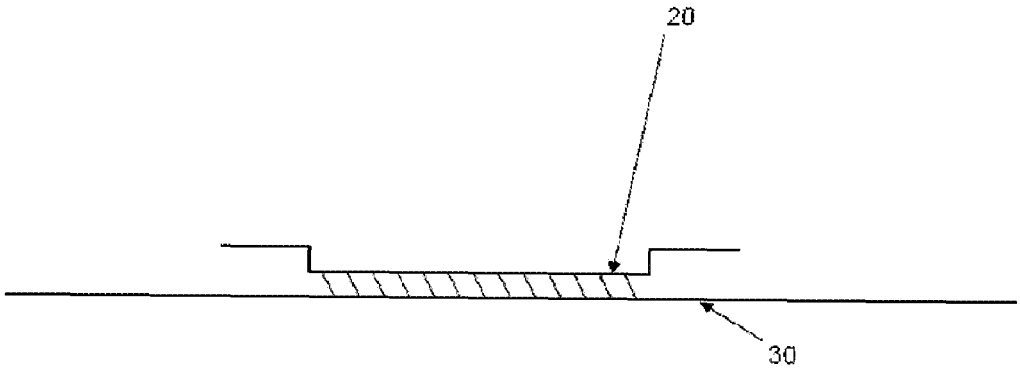
FIG. 2 illustrates installation of a base member of the presently claimed profile by heat welding.
Figure 3:
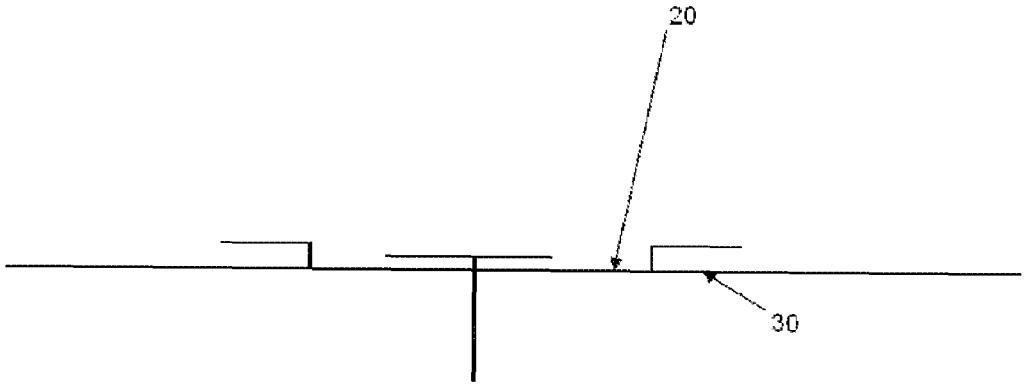
FIG. 3 illustrates installation of a base member of the presently claimed profile by mechanically fastening.

The base member of the profile can be installed, for example, by heat or tack welding, as illustrated in FIG. 2, or mechanically fastening, as illustrated in FIG. 3. In particular, the raised profile can be. welded (e.g., tack welded) to the roofing membrane or mechanically fastened to the deck below the roofing system. The cap member can be easily attached to the base member. Furthermore, after installation, the cap member can be detached from the base member, and replaced with a different cap member. Such replacement may be necessitated by wear of the cap member or to provide a different aesthetic to the roofing system.

Also provided is a method of improving a roofing system comprising a thermoplastic roofing membrane. The method comprises installing a base member of a thermoplastic coated raised metal profile on the roofing system and attaching a cap member of the thermoplastic coated raised metal profile to the base member.

In an embodiment, wherein the one or more raised metal profiles (or ribs) comprise one or more thermoplastic coated raised metal profiles, instead of a separate clip to which the rib is attached, a thermoplastic (e.g., PVC) layer can be welded to the bottom of the rib. The thermoplastic layer can have a thickness of, for example, about 20 to 100 mils or about 50 to 60 mils, and a width of, for example, about 1 to 12 inches or about 2.5 to 3 inches. The one or more thermoplastic coated raised metal profiles to which is welded a thermoplastic layer is then attached to the roof system by welding (e.g., tack welding) the thermoplastic layer to the roofing membrane. Welding can be done at about two foot intervals, which avoids the need to use automated welding.

Accordingly, a method of improving a roofing system comprising a thermoplastic roofing membrane can comprise installing one or more thermoplastic coated raised metal profiles on the roofing system, wherein a side of the one or more thermoplastic coated raised metal profiles comprises a thermoplastic layer, and installing the one or more thermoplastic coated raised metal profiles on the roofing system comprises welding the thermoplastic layer to the thermoplastic roofing membrane.

Figure 4:
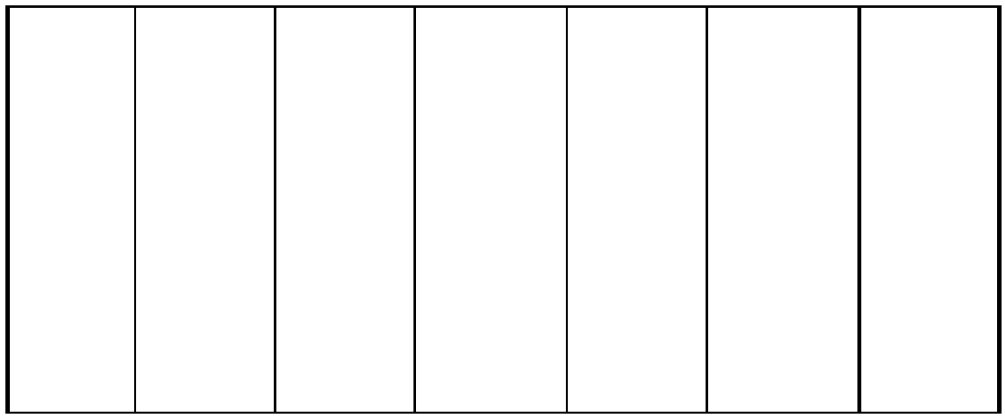
FIG. 4 illustrates the presently disclosed profiles arranged in a parallel rib design.
Figure 5:
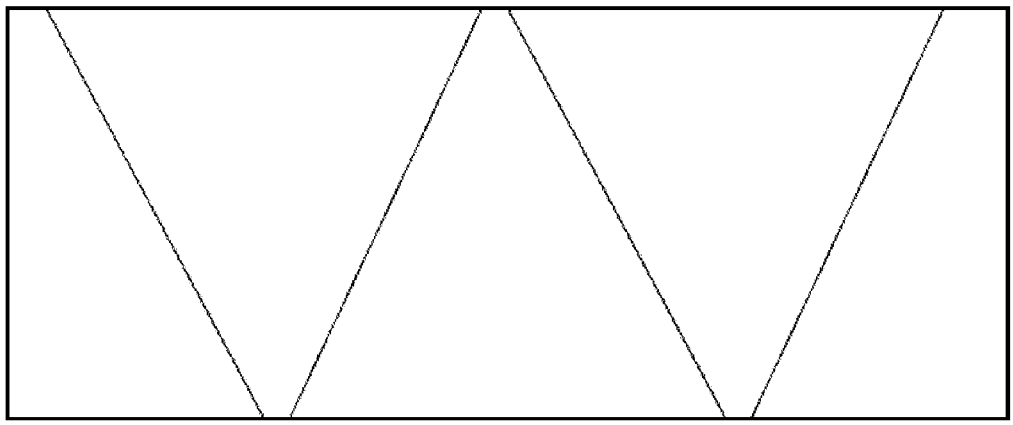
FIG. 5 illustrates the presently disclosed profiles arranged in a herringbone.
Figure 6:
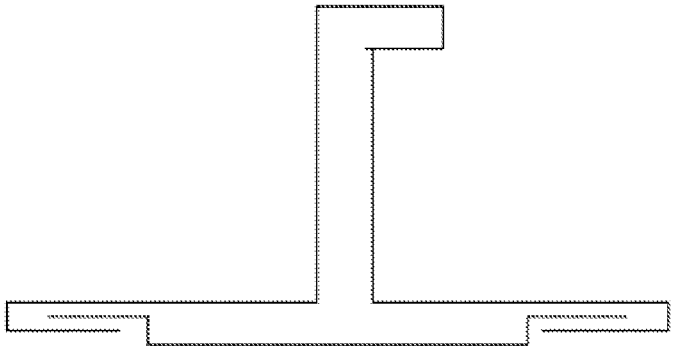
FIGS. 6, 7, and 8 illustrate exemplary shapes of the presently disclosed profile.
Figure 7:
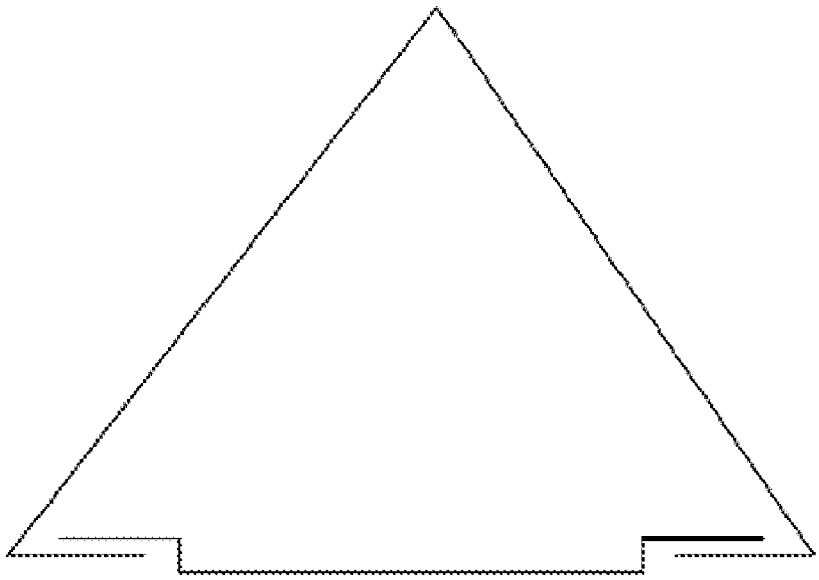
Figure 8:
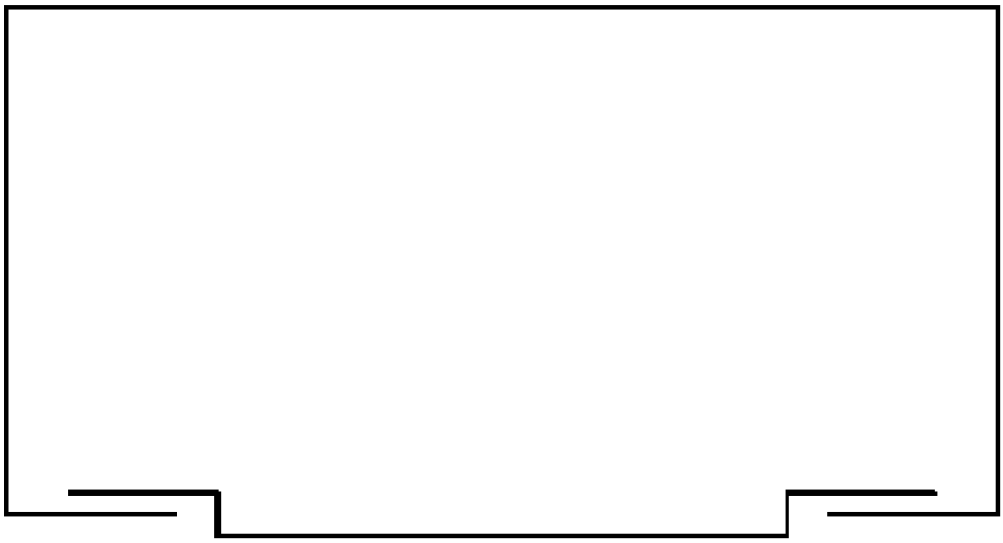

The presently disclosed raised metal profiles can be applied to thermoplastic roofing membrane systems in decorative designs. For example, the raised metal profiles can be arranged in a parallel rib design as illustrated in FIG. 4, a herringbone pattern as illustrated in FIG. 5, or any other desirable design. While various shapes for the profiles are illustrated in FIGS. 6, 7 and 8, a raised profile of any shape can be used. More specifically, FIG. 7 illustrates a raised profile with a triangular cross-sectional shape, while FIG. 8 illustrates a raised profile with a rectangular cross-sectional shape.

Figure 9:
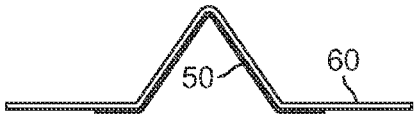
FIGS. 9 and 10 illustrate an embodiment with the metal profile underneath the thermoplastic roofing membrane.
Figure 10:
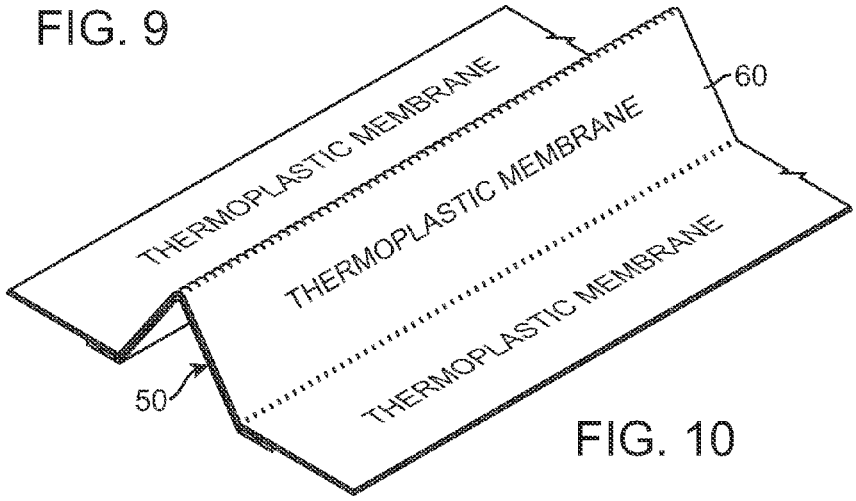

FIGS. 9 and 10 depict an embodiment where the metal profile 50 is bonded underneath the thermoplastic roofing membranes 60. The metal profile can be bonded to the thermoplastic membrane by any suitable means, such as an adhesive. The metal profile is preferably of an upside down "V" shape or of a triangle shape, as depicted. The thermoplastic membrane 60 acts as a coating for the metal profile 50.

Figure 11:
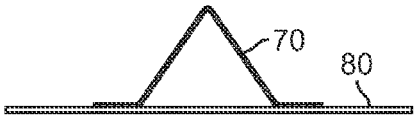
FIGS. 11 and 12 illustrate an embodiment with the metal profile being a two piece section having a thermoplastic coating layer.
Figure 12:
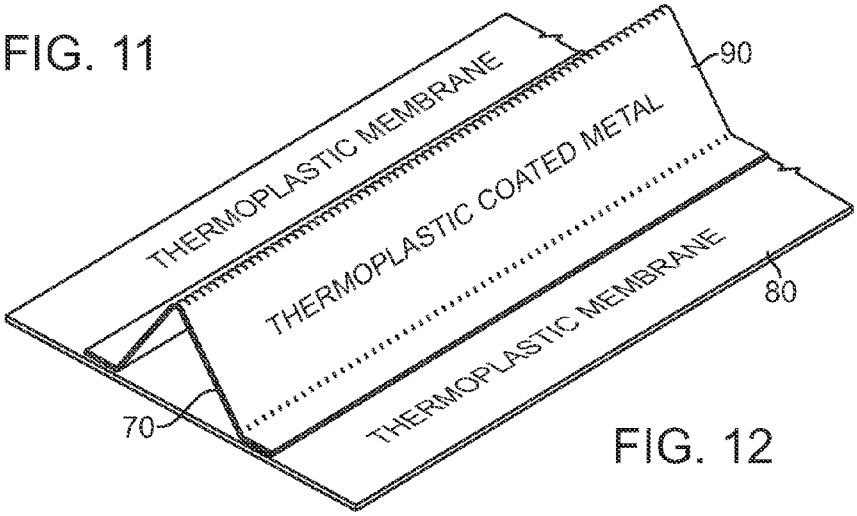

FIGS. 11 and 12 illustrate an embodiment where the metal profile 70 is on top of the thermoplastic roofing membrane 80 and bonded thereto. As shown in FIG. 12, the metal profile can be a two piece section comprising the metal profile base 70 and a thermoplastic coating 90 on the metal profile.

Both aesthetic and structural benefits are realized by utilizing the presently disclosed raised profiles. In terms of aesthetics, the raised profiles can provide the appearance of architectural standing seam metal profiles to a thermoplastic roofing system. Further, various designs (i.e., parallel ribs, herringbone pattern, etc.) can be provided to the roofing system to provide a visually appealing roofing system. Further, the profiles can provide additional mass and rigidity to the roofing system, as well as higher resistance against uplift forces.

Benefits of the raised metal profiles, as compared to a completely synthetic raised profile, include increased durability, mass, and rigidity. As noted above, the presently disclosed raised metal profiles can provide additional mass and structural rigidity to the roofing system, as well as higher resistance against uplift forces. Additionally, the presently disclosed raised metal profiles can help to contain or channelize a fire. In particular, the metal core of the profiles will not burn, and may provide a barrier to the fire from spreading.

While various embodiments have been described, it is to be understood that variations and modifications may be resorted to as will be apparent to those skilled in the art. Such variations and modifications are to be considered within the purview and scope of the claims appended hereto.

The invention claimed is:

1. A method of improving a roofing system comprising a thermoplastic roofing membrane, the method comprising:

providing one or more base members, a side of each base member being coated with a thermoplastic layer;

welding the one or more base members to a top side of the thermoplastic roofing membrane, each base member comprising a lower portion lying against the thermoplastic roofing membrane, the lower portion having two edges, and each base member further comprising two edge portions extending from the base member at the respective two edges and a flange member extending from each of the respective two edge portions, the two flange members each including a top surface, a bottom surface, and an outer edge; and providing one or more cap members, each cap member having two edges and comprising a hook-shaped portion along each of the edges, the hook-shaped portions shaped and sized to engage with respective flange members, the hook-shaped portions extending along at least a portion of the top surface, the bottom surface, and the outer edge of the respective flange members; and attaching a cap member to each of the base members by engaging the hook-shaped portions with the flange members, forming one or more thermoplastic coated raised metal profiles attached to and overlying the thermoplastic roofing membrane.

2. The method of claim 1, wherein:

the one or more thermoplastic coated raised metal profiles comprise one or more PVC coated raised metal profiles; and the thermoplastic layer comprises a PVC layer having a thickness of about 20 to 100 mils and a width of about 1 to 12 inches.

3. A roofing system comprising:

a thermoplastic roofing membrane;

one or more base members attached over the thermoplastic roofing membrane, each base member comprising a lower portion lying against the thermoplastic roofing membrane, the lower portion having two edges, and each base member further comprising two edge portions extending from the base member at the respective two edges and a flange member extending from each of the respective two edge portions, the two flange members each including a top surface, a bottom surface opposite the top surface, and an outer edge; and a cap member attached directly to each base member, each cap member having two edges and comprising a hook-shaped portion along each of the edges, the hook-shaped portions shaped and sized to engage with respective flange members to attach each cap member to a respective base member, the hook-shaped portions extending along at least a portion of the top surface, the bottom surface, and the outer edge of the respective flange members;

wherein the one or more base members and cap members form one or more raised metal profiles attached to the thermoplastic roofing membrane.

4. The roofing system of claim 1, wherein the one or more raised metal profiles provide additional mass and rigidity to the roofing system.

5. The roofing system of claim 1, wherein the one or more raised metal profiles provide higher resistance against uplift forces.

6. The roofing system of claim 1, wherein the one or more raised metal profiles provide the appearance of an architectural seam metal profile to the roofing system.

7. The roofing system of claim 1, comprising more than one raised metal profiles attached to the thermoplastic roofing membrane arranged in parallel.

8. The roofing system of claim 1, comprising:

a thermoplastic roofing membrane; and at least two raised metal profiles attached to the thermoplastic roofing membrane, the raised metal profiles arranged in a herringbone pattern.

9. The roofing system of claim 1, wherein the one or more raised metal profiles comprise one or more thermoplastic coated raised metal profiles.

10. The roofing system of claim 9, wherein the one or more thermoplastic coated raised metal profiles comprise one or more PVC coated raised metal profiles.

11. The roofing system of claim 9, wherein a thermoplastic layer is welded to a bottom side of the one or more thermoplastic coated raised metal profiles, and wherein the thermoplastic layer is welded to the thermoplastic roofing membrane.

12. The roofing system of claim 11, wherein the thermoplastic layer comprises a PVC layer.

13. The roofing system of claim 11, wherein the thermoplastic layer has a thickness of about 20 to 100 mils.

14. The roofing system of claim 11, wherein the thermoplastic layer has a thickness of about 50 to 60 mils.

15. The roofing system of claim 11, wherein the thermoplastic layer has a width of about 1 to 12 inches.

16. The roofing system of claim 11, wherein the thermoplastic layer has a width of about 2.5 to 3 inches.

17. The roofing system of claim 1, wherein the base member includes a thermoplastic coating that is welded to the thermoplastic roofing membrane.

18. The roofing system of claim 1, wherein the roofing system further comprises a deck which the thermoplastic roofing membrane overlies, and the base member is mechanically fastened to the deck.

19. The roofing system of claim 1, comprising:

multiple base members; and cap members attached to the multiple base members.

20. The roofing system of claim 1, comprising at least two raised metal profiles that are not parallel to each other.

21. The roofing system of claim 1, wherein the two edge portions extend substantially orthogonally from the base member, and wherein the flange members extend substantially orthogonally from the respective two edge portions.

* * * * *

UNITED STATES PATENT AND TRADEMARK OFFICE

CERTIFICATE OF CORRECTION

PATENT NO. : 8,322,113 B2
APPLICATION NO. : 12/721694
DATED : December 4, 2012
INVENTOR(S) : Hal Steven Shapiro et al.

It is certified that error appears in the above-identified patent and that said Letters Patent is hereby corrected as shown below:

In the Claims:

Column 4, line 54, “1” should read --3--.

Column 4, line 57, “1” should read --3--.

Column 4, line 60, “1” should read --3--.

Column 4, line 63, “1” should read --3--.

Column 4, line 66, “1” should read --3--.

Column 5, line 4, “1” should read --3--.

Column 6, line 3, “1” should read --3--.

Column 6, line 6, “1” should read --3--.

Column 6, line 10, “1” should read --3--.

Column 6, line 13, “1” should read --3--.

Column 6, line 15, “1” should read --3--.

Signed and Sealed this
Sixteenth Day of April, 2013

Teresa Stanek Rea

Teresa Stanek Rea
*Acting Director of the United States Patent and Trademark Office*